US006851835B2

(12) United States Patent
Smith et al.

(10) Patent No.: US 6,851,835 B2
(45) Date of Patent: Feb. 8, 2005

(54) LARGE AREA SHALLOW-DEPTH FULL-FILL LED LIGHT ASSEMBLY

(75) Inventors: Todd J. Smith, Deep River, CT (US); Jon H. Lyons, Haddam, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 130 days.

(21) Appl. No.: 10/321,746

(22) Filed: Dec. 17, 2002

(65) Prior Publication Data

US 2004/0114366 A1 Jun. 17, 2004

(51) Int. Cl.[7] ..... F21V 7/00

(52) U.S. Cl. ..... 362/305; 362/304; 362/346; 362/518; 362/545; 362/800

(58) Field of Search ..... 362/304, 305, 362/346, 518, 519, 545, 297, 800

(56) References Cited

U.S. PATENT DOCUMENTS 4,964,025 A * 10/1990 Smith ..... 362/346
6,644,841 B2 * 11/2003 Martineau ..... 362/545

* cited by examiner

*Primary Examiner*—Stephen F Husar
(74) *Attorney, Agent, or Firm*—Alix, Yale & Ristas, LLP

(57) ABSTRACT

A light assembly is configured to produce a large area of light emission from an LED light source. The LED light source is mounted within a concave reflector and oriented to face the rear of the reflector. A compound reflecting surface diverts axial light from the LED away from the axis of the reflector to avoid blockage by the LED support structure. A peripheral reflecting surface redirects the diverted light. The LED light source may be a linear array of LEDs aligned with a linear focal axis of the reflector.

25 Claims, 6 Drawing Sheets

LARGE AREA SHALLOW-DEPTH FULL-FILL LED LIGHT ASSEMBLY

BACKGROUND OF THE INVENTION

1. Field of the Invention

The present invention relates generally to warning light devices, and more particularly to shallow depth, large area light assemblies and to warning light assemblies incorporating an LED light source.

2. Description of the Related Art

The prior art contains numerous examples of alternative light sources, reflectors and lenses arranged to produce particular intensities and distributions of light suited for a particular purpose. Of primary concern to designers of lights are the related concepts of efficiency and illumination distribution. By efficiency, it is meant that lighting designers are concerned with both producing the maximum quantity of light (lumens) per unit of energy (watts of electricity) and transforming that light into a useful pattern with minimal losses. Distribution refers to the precision with which a light fixture arranges the light into a desired pattern. The concept of efficiency is related to the concept of distribution because light that is scattered, e.g., not accurately directed in the desired pattern, is effectively lost by being dispersed.

Until recently, light-emitting diodes (LEDs), while recognized as efficient producers of light in terms of lumens per watt, were extremely limited in the overall quantity of light produced, rendering them unsuitable for many applications. Further, typical LEDs had a very narrow viewing angle, making them appear as point light sources unsuitable for many applications. "Viewing angle" as used herein refers to the angle, measured with respect to an axis through the center of the lens of the LED, where the light intensity has fallen to fifty (50%) of the on-axis intensity. For example, a very bright LED, producing 3 to 5 candela on axis may have a very narrow viewing angle of 8 to 15 degrees.

Recent advances in LED technology have resulted in LEDs having significantly improved overall light output. High-output (high flux) LEDs may now be a practical light source for use in signaling and warning illumination. Even though high-output LEDs have significantly greater luminous flux than previous LEDs, the total luminous flux from any given component is still relatively small, e.g., in the range of 5 to 20 candela. Modern, high flux LEDs have a wide viewing angle of 110 to 160 degrees. Thus, these newer LEDs produce a "half globe" of light in contrast to a directed "spot" of light with the older LEDs. For many applications, it may be necessary to accumulate multiple LEDs in a compact array and organize their cumulative light output to produce a light unit having an output pattern of a required size and intensity.

LEDs are attractive to lighting designers for certain applications because the light they produce is typically of a very narrow spectral wavelength, e.g., of a single pure color, such as red, blue, green, amber, etc. LEDs are extremely efficient producers of colored light because the particular chemical compound used in the die of the LED, when excited by electrical current, produces a monochromatic band of energy within the visible light spectrum. For example, a red LED will generate a narrow wavelength of light in the visible red spectrum, e.g., 625 nm+/−20 nm. No external color filtering is needed, significantly improving the efficiency of the light source. Further, LEDs are directional light sources. The light produced from an LED is primarily directed along an optical axis through the center of the lens of the LED. However, and in particular with the more recent high-output LEDs, a significant portion of the light is also directed out the sides of the lens of the LED (the above mentioned "half globe"). Accordingly, if the limited light output of an LED is to result in a practical signaling or illuminating device, as much of the light produced by each LED must be captured and directed in the desired light pattern as possible.

U.S. Pat. No. 6,318,886, assigned to the assignee of the present invention, discloses a high flux LED light assembly using conical reflectors. The conical reflectors disclosed in the '886 patent redirect light incident upon them out the face of the light assembly over a range of angles because the direction of the reflected light depends on the angular relationship between incident light and the reflecting surface. Such an arrangement, while desirably redirecting light out the front face of the assembly, undesirably does so over a range of angles, albeit a narrower range of angles than an LED in the absence of the conical reflector. Some of the reflected light reinforces light output of the LED. Other light is reflected at random angles that fail to reinforce the light output of the LED and is effectively lost by being dispersed. The light pattern produced is essentially a series of bright points of light having somewhat improved wide-angle visibility due to grooves connecting adjacent conical reflectors.

It is known in the art to use parabolic reflectors to collimate the light output from prior art light sources such as halogen bulbs or xenon flash tubes. U.S. Pat. Nos. 4,792,717 and 4,886,329, both directed to a wide-angle warning light and both assigned to the assignee of the present invention, disclose the use of a parabolic reflector comprised of a linear parabolic section including parabolic dish ends. The reflector is configured with a reflecting surface having a linear focal axis similar in configuration to the extended length of the xenon flash tube light source.

U.S. patent application Ser. No. 10/081,905, assigned to the assignee of the present invention, discloses an LED light assembly in which a linear array of equidistantly spaced high flux LEDs are arranged along the linear focal axis of a reflector having a linear parabolic section. Light emitted from the several high flux LEDs is allowed to overlap and combine while the linear parabolic reflector redirects the light into a wide angle band of light. The disclosed arrangement uses a steep parabolic reflecting surface having a short focal length. The short focal length of the reflecting surface permits mounting the LED array to the rear of the reflector. The parabolic reflecting surface redirects the off axis light from the LEDs into a partially collimated wide-angle beam. The resulting light pattern resembles a band of light with good visibility over a horizontal arc of approximately 90°.

Although LED light sources exhibit significant advantageous characteristics, replacing warning and signal light sources in warning arrays produced before the advent of the high flux LED with LED light sources is far from straightforward. To be cost-effective, LED replacement light units must have the same structural envelope and similar power requirements as the previous halogen or xenon flash tube light units. In other words, the LED replacement unit must have a similar height, width and depth to fit in the space allotted for the halogen or xenon light unit so that replacement does not require modification of the warning array which typically has an efficiently integrated structure with sophisticated functional capabilities. Thus, providing LED light units that are direct replacements for pre-existing light units designed around other light sources presents significant technical challenges.

Accordingly, there is a need in the art for a light emitter unit incorporating an LED light source that is a direct replacement for light emitter units pre-dating the advent of the high flux LED.

SUMMARY OF THE INVENTION

A first aspect of the present invention relates to a system for configuring an LED light unit that is a direct replacement for a pre-existing light unit which employs a conventional non-LED light source. The spatial constraints of the prior art warning light or array of warning lights, the radiation pattern of the non-LED light source and the desired pattern of light emission are among the factors which influenced the configuration of the pre-existing light unit. The present invention encompasses a method that begins with the structural configuration and pattern of light emission of the light unit to be replaced and "reverse engineers", with various novel techniques, an equivalent replacement LED light unit having a substantially equivalent structural envelope, light emitting area and pattern of light emission.

Briefly stated, the present invention in a preferred form utilizes an array of LEDs as a light source. The LEDs are mounted to a support that provides connection points for supply of electrical power to the LEDs. The support is also configured to efficiently transfer heat away from the LEDs. In accordance with one aspect of the present invention, the LEDs are mounted to a heat transmissive PC board and installed within a reflector in a reverse orientation such that the LEDs emit light opposite to the intended ultimate direction of light emission of the reflector. A specialized reflector organizes and redirects the light to emanate from the light assembly in the intended direction of light emission and in a desired pattern.

The reflecting surface of the reflector may comprise three distinct reflecting surfaces. A primary reflecting surface is outwardly surrounded by a peripheral reflecting surface. The primary reflecting surface is centrally interrupted by a secondary reflecting surface. The secondary and peripheral reflecting surfaces cooperate to redirect narrow angle light from the LED into the intended direction of light emission and desired pattern of light emission as will be further discussed below.

The primary reflecting surface may be defined by a first parabola that is selected to fit in the depth and width of the pre-existing light unit. A portion of a second parabola rotated around the focal point of the first parabola defines the secondary reflecting surface. The second parabola is rotated to either side of the focal point so that each lateral half of the reflector includes a portion of the first parabola, a portion of the second parabola and a peripheral reflecting surface.

The secondary reflecting surface is arranged in the path of narrow angle light emitted from an LED at the focal point of the primary reflecting surface. "Narrow angle" light is that light that would be reflected off a reflecting surface defined by the first parabola to be blocked by the PC board and its associated LEDs. The second parabola is rotated about the focal point to deflect this "narrow angle" light away from the axis of the primary reflecting surface at a pre-selected angle. The peripheral reflecting surface is arranged to reflect the light from the secondary reflecting surface in a manner that contributes to the desired pattern of light emission, e.g., substantially parallel to the intended direction of light emission.

The configuration and arrangement of the reflecting surfaces allow the overall dimensions of the LED light unit to conform to the space envelope occupied by the pre-existing light source. The PC board would intercept light emitted at a small angle relative to the axis of light emission if the reflector included only the primary reflecting surface. The secondary reflecting surface deflects the narrow angle light outwardly at an angle (relative to the axis of the primary parabolic reflecting surface) such that the narrow angle light does not intersect the PC board. The peripheral reflecting surface redirects light from the secondary reflecting surface in the direction of intended light emission. Since a significant portion of the light emitted by an LED is "narrow angle" light, its integration into the desired light pattern significantly improves the overall effectiveness the disclosed LED light assembly.

In accordance with one embodiment of the invention, the LEDs may be arranged in a linear array where the axes of light emission of the LEDs lie in a common plane. The sectional configuration of the primary, secondary and peripheral reflecting surfaces is extended along this plane to define a linear focal axis coincident with the areas of light emission of the LEDs in the array.

The longitudinally extended reflector allows light from the several LEDs in the linear array to overlap and blend into an integrated pattern of light emission substantially filling the reflector.

An object of the present invention is to provide a new and improved light unit incorporating an LED light source, where the light unit can be employed as a direct replacement for pre-existing light units using other light sources.

Another object of the present invention is to provide a new and improved method for designing a light unit incorporating an LED light source that has favorable illumination characteristics and satisfies the dimensional constraints of pre-existing light units using other light sources.

A further object of the present invention is to provide a new and improved light unit that efficiently integrates the light output of a plurality of LEDs into a substantially uniform pattern of light emission.

A yet further object of the present invention is to provide a new and improved light unit in which an LED light source produces a highly visible light pattern that substantially fills a shallow reflector.

BRIEF DESCRIPTION OF THE DRAWINGS

These and other objects, features and advantages of the invention will become readily apparent to those skilled in the art upon reading the description of the preferred embodiments, in conjunction with the accompanying drawings, in which.

DETAILED DESCRIPTION OF THE PREFERRED EMBODIMENTS

Figure 1:
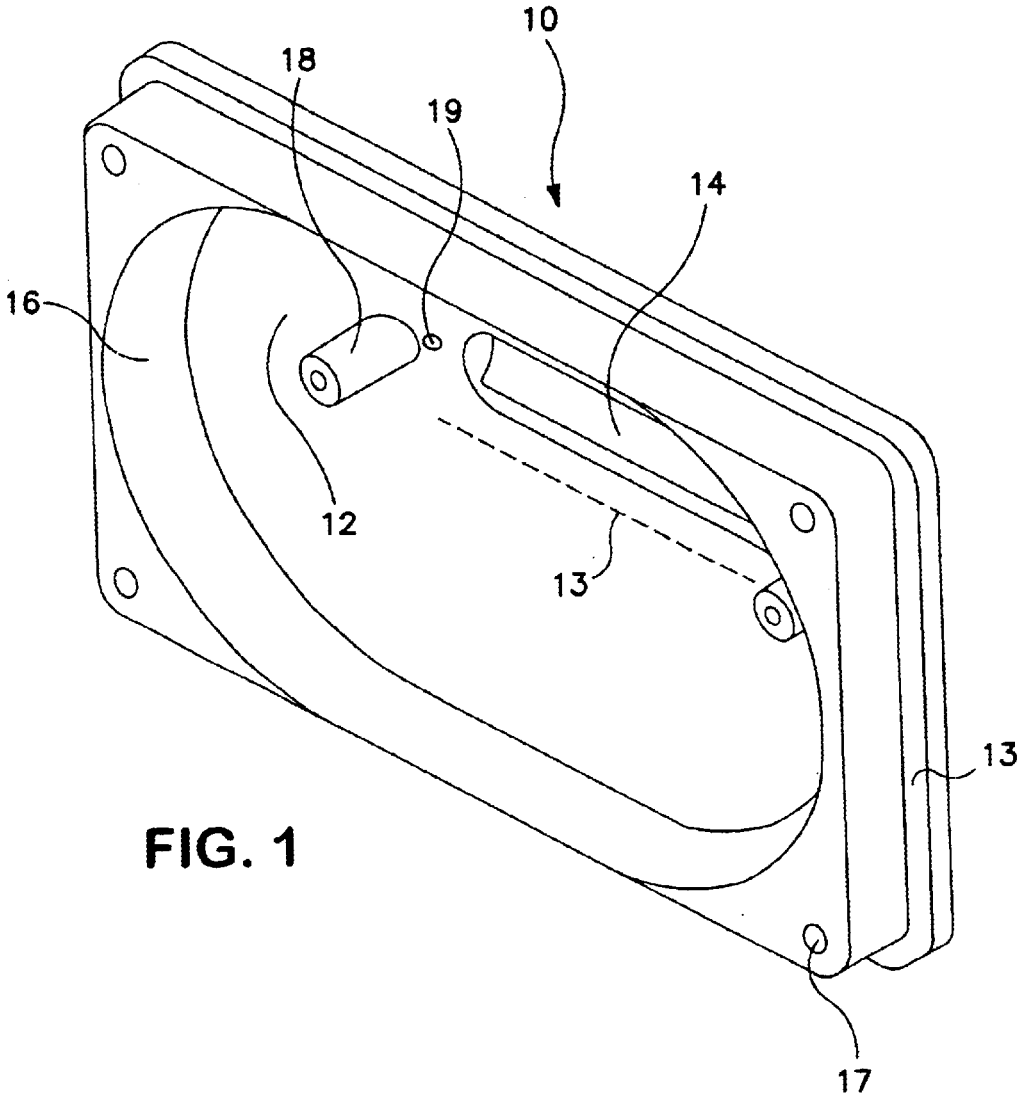
FIG. 1 is a front overhead perspective view of a reflector exemplary of several aspects of the present invention and appropriate for incorporation into an LED light assembly of the present invention.

Referring more particularly to FIGS. 1–6 wherein like numbers refer to similar parts, exemplary reflectors are designated by the numeral 10. FIG. 1 is a perspective view of an exemplary reflector 10 having a generally rectangular perimeter, a flange 13 surrounding the perimeter and fastener receptacles 17 in each corner. The overall shape, location of the flange 13 and fastener receptacles 17 allow the reflector 10 to fit into the structural envelope for a preexisting light unit which employed a non-LED light source.

Figure 1A:
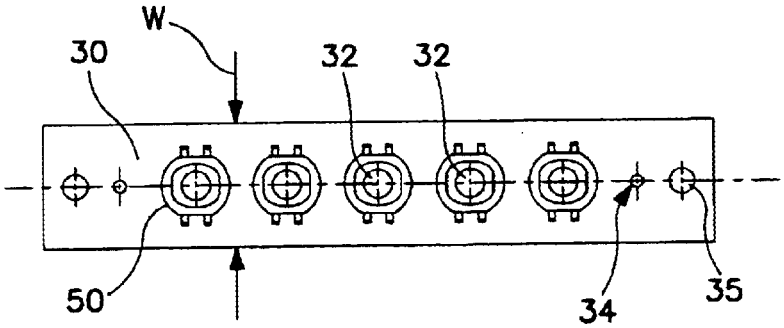
FIG. 1A is a front view of an LED array appropriate for use in conjunction with the reflector of FIG. 1.

The reflector 10 includes mounting legs 18 inside the reflector to which a PC board 30 such as that illustrated in FIG. 1A is mountable by fasteners (not shown) installed through apertures 35. Conductors (not shown) pass through holes 19 at the rear of the reflector 10 and feed power to the PC board 30 at points 34. Support for the several LEDs 50 is primarily provided by the PC board, to which the LEDs 50 are mounted in a linear array with their respective optical axes 32 in a common plane. The PC board 30 and its linear array of LEDs 50 is mounted to legs 18 with the LEDs being disposed in a reverse orientation facing (and emitting light toward) the rear of the reflector 10.

Figure 2:
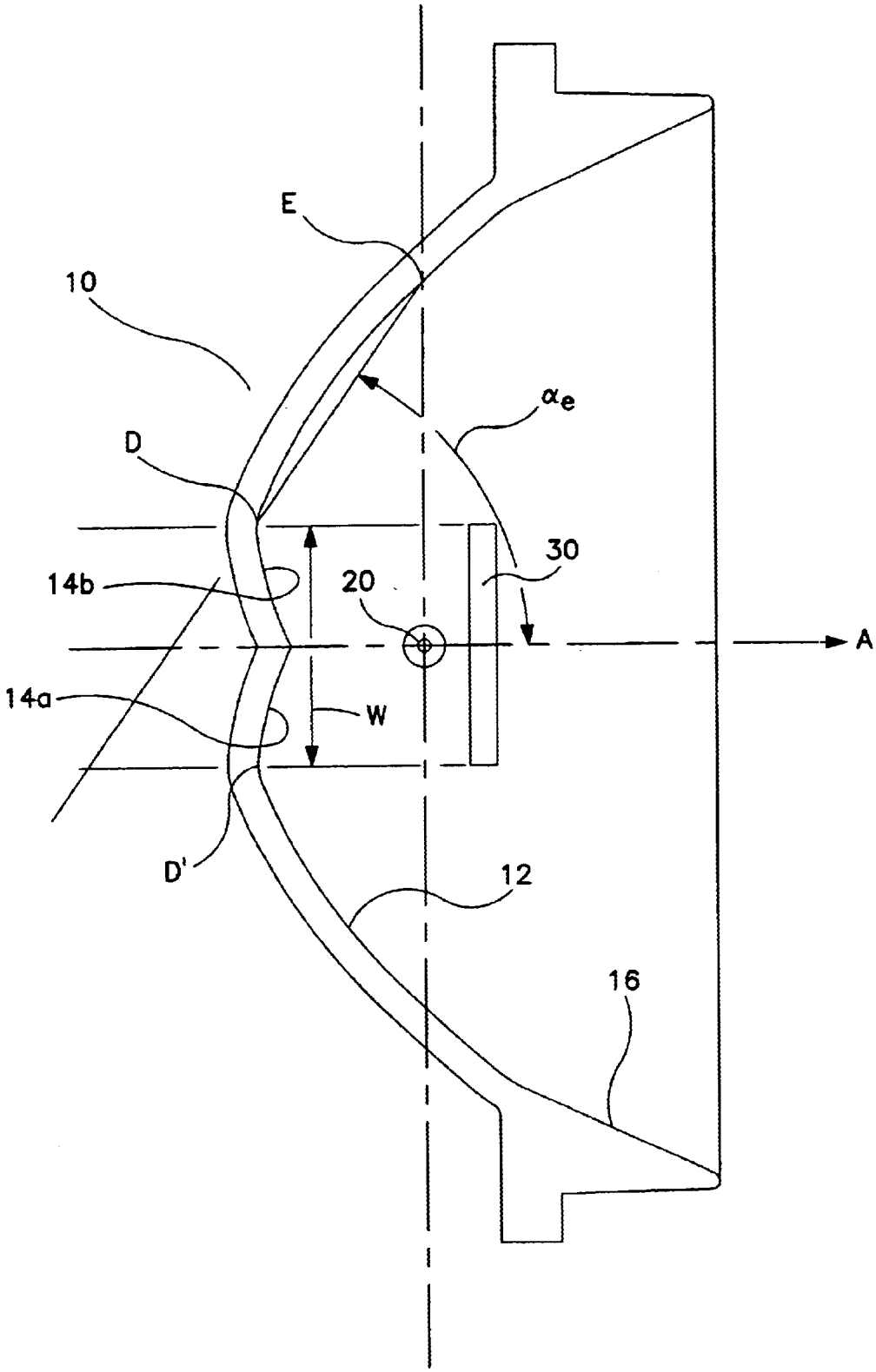
FIG. 2 is a vertical sectional view through the middle of the reflector of FIG. 1, the location of a mounted PC board and the focal point of the reflector are also shown.

FIG. 2 is a vertical section through the middle of the exemplary reflector 10 shown in FIG. 1. The reflector 10 includes three distinct reflecting surfaces 12, 14, 16. FIG. 2 also illustrates a PC board functionally positioned with respect to the reflector 10. The PC board has a lateral dimension or width W and is mounted such that LEDs secured to the PC board have their area of light emission positioned coincident with the focal point 20. Light emitted from focal point 20 toward the reflector 10 is redirected in an intended direction of light emission indicated by the arrow on axis A.

Figure 3:
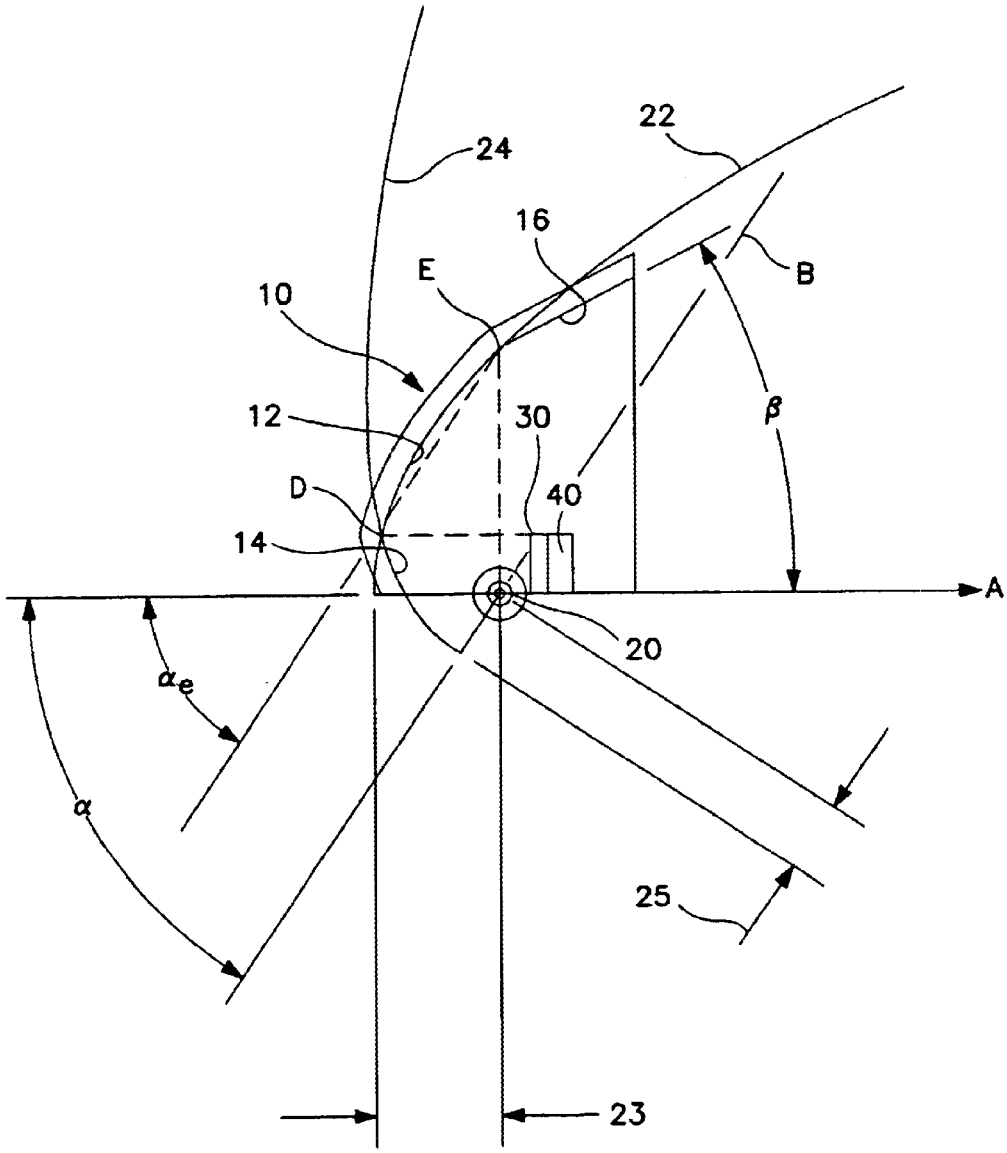
FIG. 3 is a partial vertical sectional and schematic view of an exemplary reflector of the present invention, including a partial sectional view of a functionally positioned PC board heat sink and illustrating a focal point, and first and second parabolas defining primary and secondary reflecting surfaces.

In accordance with an aspect of the present invention, a first parabola 22 with its focal point at 20 defines the primary reflecting surface 12 as illustrated in FIG. 3. The shape of the first parabola 22 is determined by the lateral width and depth of the light unit to be replaced (not shown) or by the space available for the LED light unit. For many applications, the available space allows for a parabola that has a relatively long focal length, e.g., the distance between the vertex of the parabola and its focal point. However, a broad, shallow parabolic reflecting surface with a long focal length complicates, if not precludes, the implementation of an LED light source in several ways. First, the LEDs cannot be positioned at the focal point of the reflector and oriented to emit light in the intended direction of light emission because the vast majority of the light they produce would miss the reflector entirely. (This is why lighting designers seeking a large area of light emission from an LED light source typically employ a dense array of forward facing LEDs with small narrow reflectors with short focal lengths.)

In accordance with an aspect of the present invention, the LEDs are reversed to direct their light at the reflector. This orientation ensures that virtually all of the light from the LEDs is incident on the reflector. However, if the reflector included only a reflecting surface defined by a single parabola such as parabola 22, light emitted from focal point 20 would be reflected (collimated) parallel to axis A passing through the focal point 20 and a vertex (not shown) of the parabola 22. Such a reflector configuration is unacceptable since the PC board 30 would block a significant portion of light from the LEDs. Projecting the lateral edges of the PC board 30 in a direction parallel to axis A results in points D and D' on the primary reflecting surface 12. Light reflected from a surface defined by parabola 22 between points D and D' would be blocked by the PC board 30 and effectively lost.

This lost illumination dilemma is solved by diverting light emitted from an LED at focal point 20 which would otherwise be incident upon this central portion of a parabolic reflecting surface. In accordance with an aspect of the present invention, this is accomplished by interrupting the primary reflecting surface 12 with a second reflecting surface 14 which is a composite of two substantially congruent, symmetrically disposed parabolic diverter reflecting surface segments 14*a*, 14*b* which are generally oppositely oriented. Diverter surface 14*a* is defined by a second parabola 24 which is rotated about focal point 20 to intersect with the primary reflecting surface at point D. Construction of an appropriate parabola to define the secondary reflecting surface 14 requires selection of an angle relative to axis A at which the narrow angle light will be diverted, or an "angle of diversion". The angle of diversion may be estimated by projecting the focal point 20 perpendicular to axis A to a point E on the first parabola 22. The line D-E has an angular orientation $\alpha_e$ relative to axis A which represents an estimate of the angle of diversion.

With reference to FIG. 3, a second parabola 24 is constructed having a focal point at 20 and a focal length 25. The second parabola 24 is rotated about focal point 20 until its axis B reaches the selected angle of diversion $\alpha$ relative to the axis of parabola 22. Only a single parabola 24 will intersect parabola 22 at point D when its axis B is skewed to the angle of diversion $\alpha$ and its focal point is located coincident with the focal point 20 of parabola 22. Since it is known that light emitted from the focal point of a parabola will be redirected parallel to the axis of that parabola, this canted or skewed parabolic surface 14 effectively redirects light from focal point 20 at angle $\alpha$ relative to axis A.

Diverter surface 14*b* is constructed as a mirror image by an identical parabola rotated about focal point 20 to intersect with the primary reflecting surface at point D'.

Figure 4:
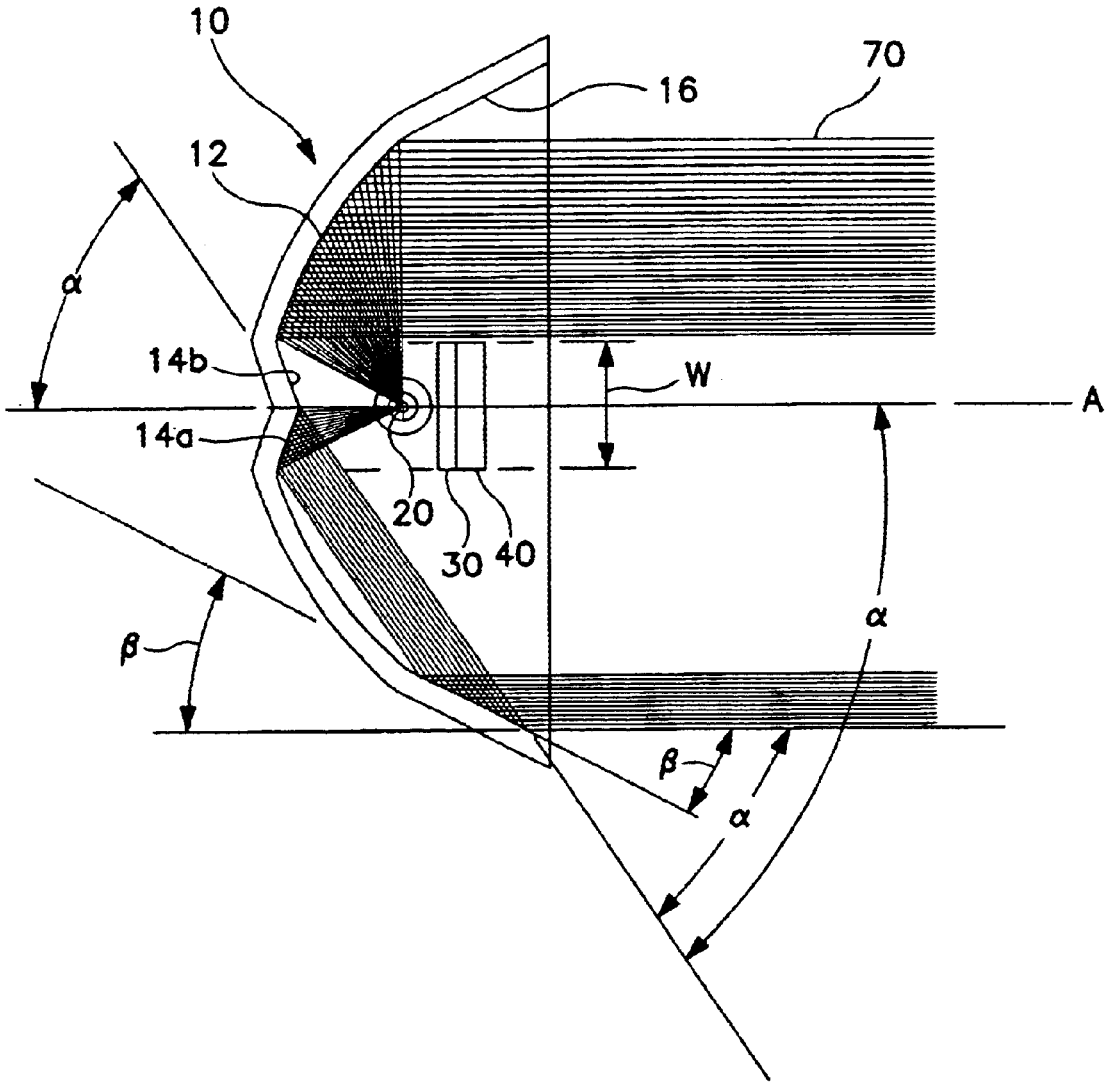
FIG. 4 is a vertical sectional and schematic view through an exemplary reflector, PC board and heat sink of the present invention and further illustrating an illumination ray diagram.

FIG. 3 illustrates the upper half of a vertical section through an exemplary reflector 10. The lower half of the reflector is constructed in a mirror image to the upper half. Narrow angle light emitted from focal point 20 is diverted away from axis A at the selected angle of diversion $\alpha$ as illustrated in FIG. 4. A peripheral reflecting surface 16 is arranged to redirect the diverted narrow angle light into the desired light emission pattern.

The exemplary reflector illustrated in FIGS. 1–5 uses parabolic primary and secondary reflecting surfaces 12, 14 to collimate light emitted from an LED at focal point 20. Narrow angle light is collimated by secondary or diverter reflecting surfaces 14*a*, 14*b* such that it forms a substantially parallel arrangement having an angle $\alpha$ relative to axis A. Arranging the peripheral reflecting surface 16 at angle $\beta$ (relative to axis A), which is one half of angle $\alpha$ results in a reflecting surface 16 which redirects the narrow angle light to a course parallel to axis A. FIG. 4 also illustrates the path of wide angle light from the LED, i.e., light that is not incident upon the secondary or diverter reflecting surface 14. This wide angle light is collimated by the primary reflecting surface 12 and redirected parallel to axis A in the intended direction of light emission.

Figure 6:
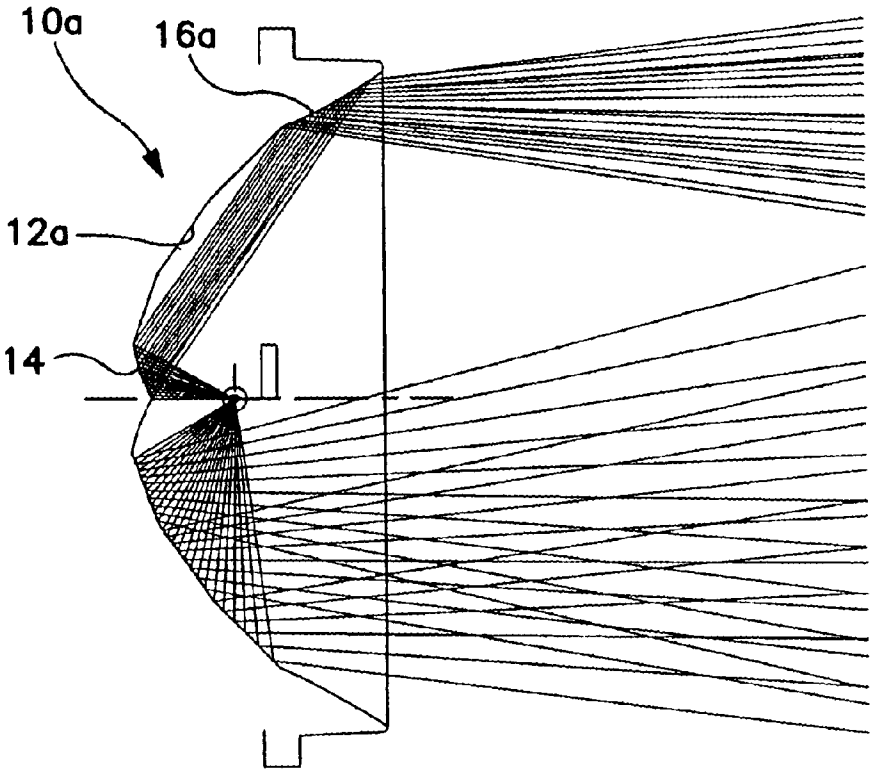
FIG. 6 is a partial vertical sectional and schematic view through an alternative embodiment of a reflector of the present invention and further illustrating an illumination ray diagram.

Light is emitted from a high flux LED in a half globe or over an arc of 110°–160° but not exceeding 180°. Thus, virtually all of the light emitted from an LED 50 mounted to PC board 30 with its point of light emission at focal point 20 is incident upon the primary or secondary reflecting surfaces 12, 14. The ray diagrams of FIGS. 4–6 show only a selected half of the LED illumination to illustrate the distribution of the output illumination and the reflection patterns.

Figure 5:
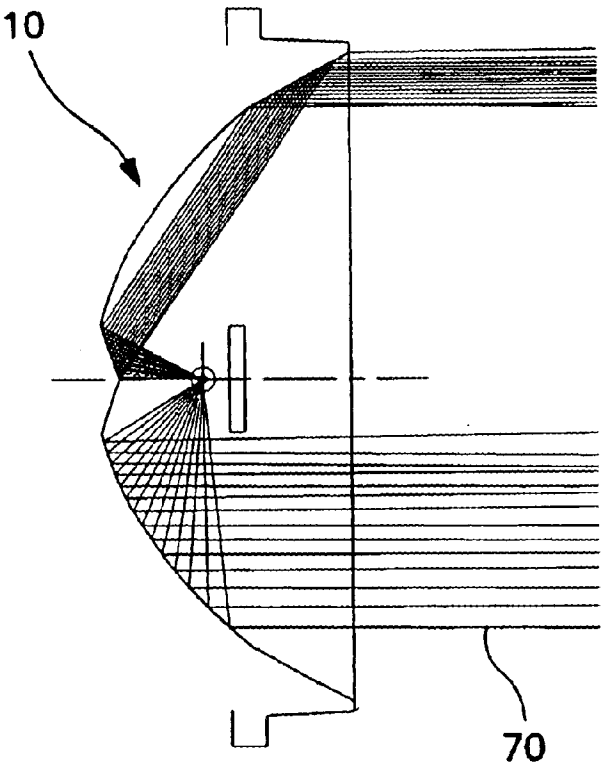
FIG. 5 is a partial vertical sectional and schematic view through a reflector similar to that illustrated in FIG. 1 and further illustrating an illumination ray diagram.

In accordance with a further aspect of the present invention, the sectional configuration illustrated in FIGS. 2, 4 and 5 is projected along a line passing through the point of light emission of each LED 50 in the linear array to define a longitudinally extending linear focal axis 13. The PC board 30 is mounted such that the linear array of LEDs 50 is aligned with the linear focal axis 13 of the extended reflector 10. Each end of the linear focal axis 13 preferably coincides with the optical axis 32 of the LED 50 at each end of the linear array. The resulting reflector is illustrated in FIG. 1.

The central secondary reflecting surface 14 integrally connects the center of the reflector 10 to the primary reflecting surface 12. The reflective surfaces 12 and 16 rotate about axes perpendicular to the ends of the linear focal axis 13. It will be observed that the interior of the reflector 10 is open and is not configured to shape the light emitted from any individual LED in particular. This open configuration permits light from the several LEDs 50 in the array to overlap and effectively integrate into a unified area of light emission.

FIG. 4 illustrates the behavior of light emitted from focal point 20 perpendicular to the length of the reflector 10. Of course, each LED 50 in the array emits light in every direction (the previously described half globe). The reflector 10 is configured to collimate light into planes 70 parallel to axis A. These planes 70 are shown edge to the viewer in FIG. 4. Within these planes, light is permitted to "spray" laterally in accordance with its angle of emission from the LED. For example, light emitted at an angle of 45°, e.g., halfway between a direction perpendicular to the length of the reflector and a direction parallel to the length of the reflector, retains this angle in its plane 70. This reflector configuration integrates light from the several LEDs into a vertically collimated wide angle beam. The resulting light pattern is particularly useful for warning and signal purposes because it is highly visible over an arc of at least 90°, or 45° to the right and left of a point directly in front of the reflector 10.

The exemplary reflector 10 illustrated in FIGS. 1–5 produces the above-described vertically collimated wide angle beam. It may be desirable to provide vertical spread to the wide angle beam to meet a particular warning or signaling light pattern standard. FIG. 6 illustrates an alternative exemplary reflector 10*a* in which the primary reflecting surface 12*a* is faceted. As shown in FIG. 6, the resulting light pattern is not vertically collimated, but provides a diverging pattern of light perpendicular to the length of the reflector 10*a*. The peripheral reflecting surface 16*a* is shown as a convex surface in FIG. 6. This convex surface 16*a* provides a vertical spread to light diverted by the secondary reflecting surface 14. FIG. 6 illustrates one example of how the basic method and configuration illustrated in FIGS. 1–5 may be modified to produce an alternative pattern of light emission. Improved vertical spread can be provided without the use of a refracting lens, thus avoiding light losses associated with lenses. These and other similar alterations to the basic method and reflector configuration that may occur to one of skill in the art are intended to be within the scope of the present invention.

Figure 7:
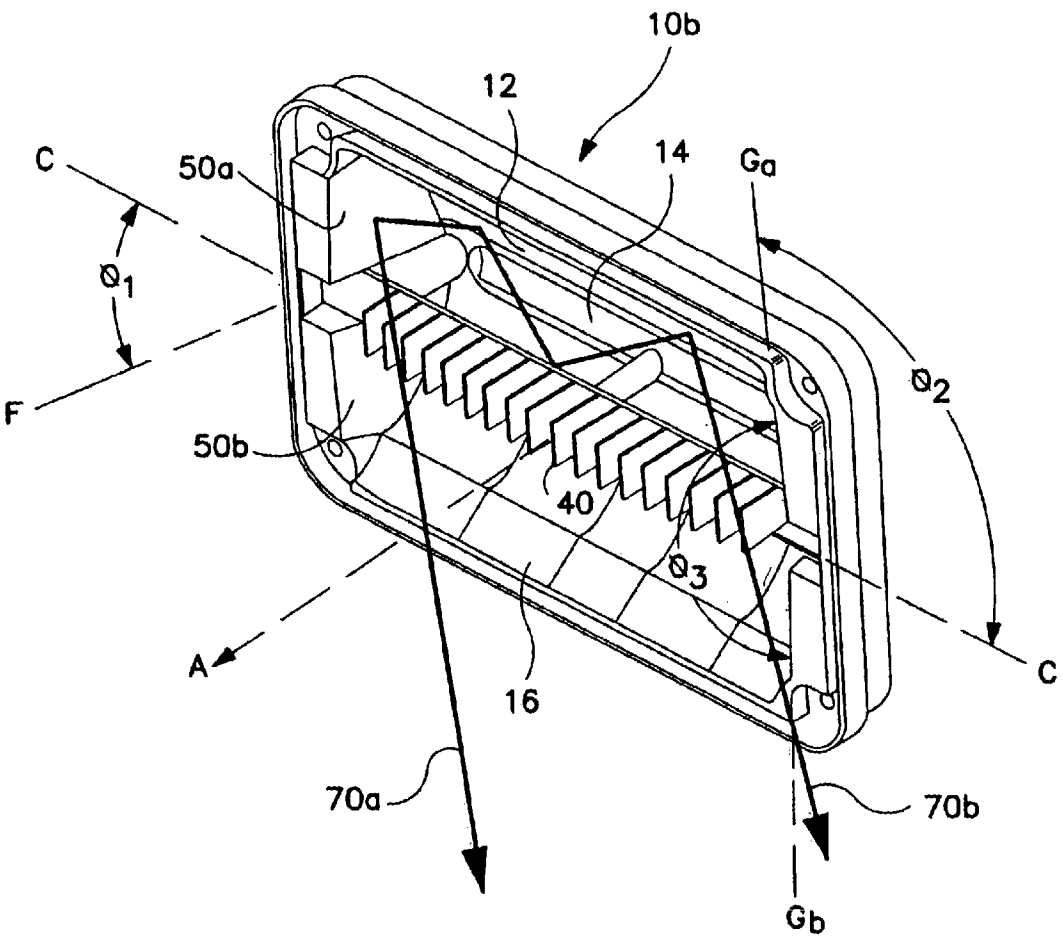
FIG. 7 is a front overhead perspective view of an LED light assembly incorporating an alternative reflector exemplary of further aspects of the present invention.

Parabolic dish ends, as shown on reflector 10 in FIG. 1, tend to re-direct (collimate) light incident upon them to a path perpendicular to the longitudinal and vertical axes of the reflector. This re-direction tends to reinforce the center of the wide-angle beam. It may also be desirable to enhance the horizontal spread of the wide-angle beam produced by the reflector 10 illustrated in FIG. 1. Alternatively expressed, it may be desirable to enhance the intensity of the light pattern at points 450 to the right and left of a point directly in front of the reflector. FIG. 7 illustrates a light assembly incorporating an alternative reflector 10*b* configured for this purpose.

Reflector 10*b* replaces each of the parabolic dish ends of the reflector with a pair of planar surfaces 50*a*, 50*b*. The planar surfaces 50*a*, 50*b* have an angular orientation selected to reflect light to reinforce the horizontal outward ends of the light pattern, e.g., at 45° to the right and left of a point directly in front of the reflector in a horizontal plane. As shown in FIG. 7, light incident upon the left end planar surfaces 50*a*, 50*b* is redirected to reinforce the right-hand outward end of the resulting light pattern. Light incident upon the right end planar surfaces likewise is redirected to reinforce the left-hand outward end of the resulting light pattern. The angular relationship between the planar surfaces 50*a*, 50*b* in a vertical plane is illustrated by lines C, $G_a$ and $G_b$. The angle $\theta_3$, formed between lines $G_a$ and $G_b$ represents the angular relationship between planar surfaces 50*a*, 50*b* in a vertical plane passing through the reflector 10*b*. In the illustrated reflector 10*b*, this angle $\theta_3$ is less than 180°. This selected angular orientation tends to concentrate reflected light into the horizontal band. Angle $\theta_2$ between line $G_a$ and line C (representing a longitudinal axis of the reflector) is an oblique angle.

The angular relationship between planar surface 50*a* and the remainder of the reflector 10*b* in a horizontal plane is illustrated by lines C, F and included angle $\theta_1$. Line F is closer to the central axis A of the reflector at the rear of the reflector and farther from the central axis A at the front of the reflector. The resulting angle $\theta_1$ is an acute angle. Angle $\theta_1$ is selected so that the planar surface 50*a* redirects light generally toward the right-hand outward end of the light pattern as shown by the representative light rays 70*a*, 70*b*. Light ray 70*a* reflected by planar surface 50*a* is directed to reinforce light ray 70*b* reflected by primary reflecting surface 12. Thus, the light pattern of the light assembly 10*b* may be tailored to suit a particular application. It is acknowledged that similar tailoring could be accomplished by means of an appropriate lens. However, it is more efficient to accomplish the tailoring with a reflector because the losses inherent in refraction through a lens are avoided. Further, the necessity for a lens in addition to the necessary protective outer shell of a light bar is avoided.

The dimensions of the PC board 30 are determined by several factors. These factors include but are not limited to the size of the high flux LED components, assembly methods and equipment, and the need to transfer heat away from the LED to a heat sink 40 mounted to the rear of the PC board 30. In other words, the PC board 30 must have a large enough surface to support the LEDs, provide access for assembly and have sufficient surface area to transfer heat efficiently to the heat sink 40. The lateral width of the PC board for the illustrated embodiment is in the range of approximately ⅜" to ⅝". The invention can accommodate changes in the lateral width of the PC board by changing the selected angle of diversion α.

As will be understood from the foregoing description, an aspect of the foregoing invention is a method for determining the shape and relative position for three reflecting surfaces 12, 14, 16 that make up a reflector 10 for a light unit utilizing an LED light source. The primary reflecting surface 12 is defined by a first parabola 22 selected according to the dimensions of the preexisting light unit to be replaced. This primary reflecting surface 12 has a focal length 23 and an axis A. A PC board mounted LED light source is arranged with its area of light emission coincident with the focal point 20 of the primary reflecting surface 12. The width W of the PC board is then projected onto the first parabola 22 to determine points D and D'. Another line is drawn through the focal point 20 and perpendicular to the axis A of first parabola 22 to intersect the first parabola 22 at point E. Connecting points D and E results in a line having an angle $\alpha_e$ relative to the axis A of the first parabola. In accordance with one aspect of the present invention, this angle $\alpha_e$ is substantially equal to the selected angle of diversion α. Minor variations of approximately 10% between the selected angle of diversion α and the angle $\alpha_e$ determined by connecting points D and E are within the scope of the present invention.

Once the selected angle of diversion α is known, a second parabola 24 can be drawn with its axis B at the selected angle of diversion α relative to axis A and its focal point at 20 to intersect the first parabola 22 at point D. The portion of the second parabola between axis A and point D defines the secondary reflecting surface 16. The selected angle of diversion α also permits construction of the third reflecting surface 16.

The resulting reflector and LED light source assembly, when provided with an appropriate power supply and ballast (driver circuit, not shown), occupies the same structural envelope as the preexisting light unit. In accordance with an aspect of the invention, an LED light unit in accordance with the present invention will mount to the same points and will radiate light from an area substantially equivalent to the light unit to be replaced.

The pattern of light radiation from a light unit in accordance with the present invention substantially fills the reflector 10. The result is a highly visible light unit incorporating reliable and efficient LEDs that is a direct replacement for preexisting light units. The various parameters of the reflecting surfaces are derived from the configuration of the light unit to be replaced, the desired pattern of light emission and the properties and dimensions of the PC board mounted LED array. The methods in accordance with the present invention permit efficient production of replacement light heads utilizing LEDs for a wide variety of preexisting light unit configurations.

LEDs are more efficient and several times longer lasting than any preexisting light source commonly in use. A further advantage of an LED is that it has an extremely fast turn-on and turn-off time. Fast turn-on and turnoff allow an LED light source to be energized in a manner that mimics a strobe or a rotating flasher. Further, and unlike a xenon flash tube, the LED light sources can be energized in a steady "on" state. In sum, an LED light source in accordance with the present invention can be energized to duplicate the light radiation pattern of strobes, halogens, flashers, "steady on" or any preexisting light. The result is an extremely efficient and durable replacement light head that eliminates the need for several alternative configurations of preexisting light unit. Thus, with an appropriate ballast, an LED light unit in accordance with the present invention eliminates the need to stock and supply alternative configurations of light unit. Further, LEDs are available in a variety of pure colors—red, blue, yellow in addition to more recently available white LEDs. Thus, light units providing colored light and not requiring colored filters or other light-trapping components provide efficient sources of colored light for emergency vehicles.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A light assembly having an intended direction of light emission, said light assembly comprising:

a generally concave reflector defining a compound reflecting surface which flares to a front opening in the direction of light emission, said compound reflecting surface comprising:

a primary reflecting surface defined by a portion of a first parabola having a first focus and a first axis; and a secondary reflecting surface defined by a portion of a second parabola having a second focus and a second axis, said secondary reflecting surface interrupting said primary reflecting surface within an angle originating at said first focus and bisected by said axis, said angle being in the range of 30° to 90°, wherein said second focus is coincident with said first focus and said second axis is angularly offset relative to said first axis by an angle of deflection a in the range of 30° to 70°, and said secondary reflecting surface comprises that portion of said second parabola extending between said first axis and said first parabola;

a light source support having a length and a width, said length and width measured perpendicular to said direction of light emission;

an LED light source comprising at least one LED mounted to said light source support, said at least one LED having a point of light emission and an optical axis originating at said point of light emission;

said light source support mounted within said reflector with the at least one LED point of light emission coincident with said first focus and said optical axis aligned with said first axis, said LED light source arranged to emit light in a direction opposite to the intended direction of light emission.

2. The light assembly of claim 1, wherein light from said LED light source incident upon said secondary reflecting surface is diverted away from the first axis at an angle equal to said angle of diversion α and said compound reflecting surface comprises a peripheral reflecting surface separated from the secondary reflecting surface by said primary reflecting surface, the peripheral reflecting surface being a substantially linear surface with an angular orientation β relative to said first axis of one half (½) said angle of deflection α.

3. The light assembly of claim 1, wherein:

said light source support extends longitudinally and said at least one LED comprises a plurality of longitudinally spaced LEDs arranged on said support with a first line passing through their respective points of light emission to form a linear array;

said reflecting surface longitudinally extends along a second line passing through said first focus to form a reflecting surface having a linear focal axis; and said light source support is mounted within said reflector with said first line substantially coincident with said linear focal axis.

4. The light assembly of claim 3, wherein said linear focal axis has longitudinally spaced ends and a longitudinal end of said reflecting surface is defined by rotating said primary reflecting surface about an axis through a longitudinal end of said linear focal axis.

5. The light assembly of claim 3, wherein said linear focal axis has longitudinally spaced ends and a longitudinal end of said reflecting surface comprises a planar reflecting surface having an angular relationship to the linear focal axis selected to reinforce a laterally outward end of a light pattern produced by the light assembly.

6. The light assembly of claim 3, wherein said linear focal axis has longitudinally spaced ends and a longitudinal end of said reflecting surface comprises a pair of planar reflecting surfaces, each having an angular relationship to the linear focal axis selected to reinforce a laterally outward end of a light pattern produced by the light assembly, said planar reflecting surfaces having an angular relationship relative to each other selected to reinforce said light pattern at the laterally outward end in a region adjacent a horizontal plane horizontally bisecting the reflector.

7. The light assembly of claim 1, wherein said first parabola has a focal length that is greater than a focal length of said second parabola.

8. The light assembly of claim 1, wherein said primary and secondary reflecting surfaces are rotated about said focal point to define a substantially circular concave reflector.

9. A generally concave reflecting surface for redirecting light from an LED light source into an intended direction of light emission, said reflecting surface symmetrically arranged around a linear focal axis extending between first and second longitudinally spaced ends, said reflecting surface at least partially defined by:

a first parabola having a first focal length, a first vertex, a first focus and a first axis; and a second parabola having a second focal length, a second vertex, a second focus coincident with said first focus and a second axis having an angular orientation $\alpha$ relative to said first axis, wherein a central portion of said reflecting surface is defined by a portion of said second parabola extending between an intersection of said second parabola with said first axis and an intersection of said second parabola and said first parabola and said reflecting surface outwardly of said central portion is partially defined by a portion of said first parabola.

10. The reflecting surface of claim 9, wherein said first focal length is greater than said second focal length.

11. The reflecting surface of claim 9, wherein said angle $\alpha$ is in the range of 30° to 70°.

12. The reflecting surface of claim 9, comprising a peripheral reflecting surface which defines the outer perimeter of said reflecting surface, said peripheral reflecting surface being substantially linear in a plane including said first axis and having an angular orientation $\beta$ relative to said first axis, $\beta$ being approximately one half (½) of $\alpha$.

13. A light assembly comprising:

a generally concave reflector having a longitudinal length and a lateral width and defining a reflecting surface which flares to a front opening to define a direction of light emission, said reflecting surface symmetrically arranged relative to a central plane parallel to said direction, said reflecting surface comprising:

a primary reflecting surface defined by portions of a first parabola having a first focus and a first axis; and a pair of canted secondary reflecting surfaces symmetrically disposed relative to said first axis, each secondary reflecting surface defined by a portion of a second parabola having a respective second focus coincident with said first focus and a respective second axis angularly offset from said first axis by an angle of diversion $\alpha$, each said secondary reflecting surface comprising that portion of a respective second parabola extending between said first axis and said first parabola;

a light source support mounted within said reflector and forming an optical barrier extending generally perpendicular to said direction of light emission; and at least one LED having a viewing angle with a vertex at a point of light emission and symmetrically arranged with respect to an optical axis of the LED, said LED mounted to said light source support with said point of light emission generally coincident with said first focus and said optical axis generally aligned with said first axis and oriented generally opposite to said direction of light emission, wherein substantially all light emitted from said LED incident upon said primary reflecting surface is reflected in the direction of light emission and substantially all light from said LED incident upon said secondary reflecting surfaces is reflected at said angle of diversion $\alpha$ relative to said first axis to a point outward of said optical barrier.

14. The light assembly of claim 13, wherein said reflecting surface comprises:

a peripheral reflecting surface comprising a pair of peripheral reflecting surface portions laterally separated from said secondary reflecting surfaces by said primary reflecting surfaces, each of said peripheral reflecting surface portions being substantially linear and having an angular orientation $\beta$ relative to said first axis of one half (½) said angle of diversion $\alpha$, each of said peripheral reflecting surface portions arranged to receive substantially all light reflected by respective of said secondary reflecting surfaces and redirect said light in the direction of light emission.

15. The light assembly of claim 13, wherein said length is greater than said width and said primary and secondary reflecting surfaces are projected along a line passing through said first focus to form a trough-like reflector.

16. The light assembly of claim 13, wherein said length is greater than said width and said primary and secondary reflecting surfaces are projected along a focal axis line passing through said first focus to form a trough-like reflector and said at least one LED comprises a plurality of LEDs arranged in a longitudinally spaced linear array with the focal axis line passing through the points of light emission of the respective LEDs.

17. The light assembly of claim 16, wherein a longitudinal end of said reflecting surface is defined by rotation of the adjacent primary reflecting surface and peripheral reflecting surface about an axis through said end.

18. The light assembly of claim 16, wherein a longitudinal end of said reflecting surface is defined by a planar surface having an angular relationship to the linear focal axis selected to reinforce a laterally outward end of a light pattern produced by the light assembly.

19. The light assembly of claim 16, wherein a longitudinal end of said reflecting surface is defined by a pair of planar surfaces, each having an angular relationship to the linear focal axis selected to reinforce a laterally outward end of a light pattern produced by the light assembly, said planar surfaces having an angular relationship relative to each other selected to reinforce said light pattern at the laterally outward end in a region adjacent a horizontal plane horizontally bisecting the reflector.

20. A light assembly having a forward direction of light emission, said light assembly comprising:

a reflector defining a reflecting surface, said reflecting surface comprising:

a secondary reflecting surface portion occupying a middle of the reflector;

a peripheral reflecting surface portion defining an outer periphery of said reflecting surface; and a primary reflecting surface portion intermediate said secondary and peripheral reflecting surface portions; and a light source assembly comprising an LED having an optical axis and a light output, said LED arranged to direct said light output at said reflecting surface in a direction opposite to said direction of light emission, said light source assembly disposed forwardly from said secondary reflecting surface and forming an optical barrier between said secondary reflecting surface portion and a location forwardly from said reflector in said direction of light emission, a first portion of said light output being incident upon said secondary reflecting surface portion and a second portion of said light output being incident upon said primary reflecting surface portion, wherein said secondary reflecting surface portion diverts the first portion of said light output away from said optical axis at an angle of diversion $\alpha$, said peripheral reflecting surface portion arranged to receive the diverted first portion of said light output and reflect it generally forwardly from the reflector and said primary reflecting surface portion reflects the second portion of said light output generally in the direction of light emission.

21. The light assembly of claim 20, wherein said reflecting surface is bisected by a line parallel to the direction of light emission and said secondary reflecting surface portion is defined by a portion of a parabola having an axis and a focus, said axis being angularly offset relative to said line by said angle of diversion $\alpha$, the portion of said parabola defining said secondary reflecting surface portion being that portion of the parabola extending between an intersection of said parabola with said line and an intersection of said parabola with said primary reflecting surface portion.

22. The light assembly of claim 20, wherein said reflecting surface is bisected by a line parallel to the direction of light emission and said primary and peripheral reflecting surfaces are configured to spread light emitted from the light assembly over an arc centered on said line.

23. The light assembly of claim 22, wherein said reflecting surface has a length and a width, said length being greater than said width to form a trough-like reflecting surface.

24. The light assembly of claim 23, comprising a plurality of LEDs arranged in a linear array.

25. The light assembly of claim 20, wherein at least a portion of said reflecting surface is faceted.

* * * * *